US008459944B2

(12) United States Patent
Hamana

(10) Patent No.: US 8,459,944 B2
(45) Date of Patent: Jun. 11, 2013

(54) STATOR BLADE RING AND AXIAL FLOW COMPRESSOR USING THE SAME

(75) Inventor: Hiroyuki Hamana, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 474 days.

(21) Appl. No.: 12/520,904

(22) PCT Filed: Jun. 22, 2007

(86) PCT No.: PCT/JP2007/062597

§ 371 (c)(1),
(2), (4) Date: Aug. 18, 2009

(87) PCT Pub. No.: WO2009/001415

PCT Pub. Date: Dec. 31, 2008

(65) Prior Publication Data

US 2010/0098537 A1 Apr. 22, 2010

(51) Int. Cl.
*F01D 9/04* (2006.01)

(52) U.S. Cl.
USPC ..... 415/210.1; 415/215.1

(58) Field of Classification Search
USPC ..... 29/889.22; 415/209.3, 209.4, 210.1, 415/215.1
See application file for complete search history.

(56) References Cited

U.S. PATENT DOCUMENTS

| | | | | |
|---|---|---|---|---|
| 2,221,684 | A * | 11/1940 | Smith | 416/191 |
| 2,497,041 | A * | 2/1950 | Bodger | 415/209.4 |
| 2,654,566 | A | 10/1953 | Boyd et al. | |
| 3,071,346 | A | 1/1963 | Broffitt | |
| 3,326,523 | A * | 6/1967 | Bobo | 415/209.3 |
| 5,022,818 | A | 6/1991 | Scalzo | |
| 5,494,404 | A * | 2/1996 | Furseth et al. | 415/209.3 |
| 2010/0135782 | A1 | 6/2010 | Nakamura et al. | |

FOREIGN PATENT DOCUMENTS

| | | | |
|---|---|---|---|
| EP | 0384166 | A2 | 1/1990 |
| JP | 58-57276 | A | 12/1983 |
| JP | 59-2761 | A | 1/1984 |
| JP | 60-216004 | A | 10/1985 |
| JP | 2-245403 | A | 10/1990 |
| JP | 2002-242611 | A | 8/2002 |

OTHER PUBLICATIONS

International Search Report of PCT/JP2007/062597, Mailing Date of Aug. 7, 2007.
U.S. Appl. No. 12/449,828, filed Oct. 20, 2009.
Japanese Decision to Grant a Patent dated Nov. 6, 2012, issued in corresponding Japanese patent application No. 2008-156728.

* cited by examiner

*Primary Examiner* — Edward Look
*Assistant Examiner* — Liam McDowell
(74) *Attorney, Agent, or Firm* — Westerman, Hattori, Daniels & Adrian, LLP

(57) ABSTRACT

A stator blade ring is provided with which the possibilities of thermal deformation and a decrease in strength can be reduced, the shape flexibility can be ensured, and the compression performance can be improved. It includes stator blade segments (21) in each of which an inner shroud portion (31) and an outer shroud portion (29) divided corresponding to one stator blade (27) are provided at both ends of the stator blade (27) so as to be formed as a single part, and connecting members (23) that are formed of arch-shaped plates and are disposed on at least one of the inner shroud portions (31) and the outer shroud portions (29) of the stator blade segments (21) adjoining in a circumferential direction, on a side opposite to the stator blades (27). The stator blade segments (21) are welded to the connecting members (23) at a portion of the length thereof in the circumferential direction.

5 Claims, 6 Drawing Sheets

STATOR BLADE RING AND AXIAL FLOW COMPRESSOR USING THE SAME

TECHNICAL FIELD

The present invention relates to axial flow compressors such as gas turbine compressors, and more specifically, to stator blade rings of the axial flow compressors.

BACKGROUND ART

In a stator blade ring of an axial flow compressor, multiple (for example, several tens to several hundreds) stator blades are arranged at substantially equal intervals in the circumferential direction.

As shown in Patent Documents 1 and 2, for example, many of the conventional stator blade rings are assembled in such a manner that both ends of the stator blades are fitted into holes in inner and outer shrouds constituting chamber walls to be temporarily mounted, and electron-beam welding is performed in the circumferential direction from the side surfaces of the shrouds to join the stator blades and the inner and outer shrouds.

Patent Document 1: Japanese Examined Patent Application, Publication No. Sho 58-57276

Patent Document 2: Japanese Examined Patent Application, Publication No. Sho 59-2761

DISCLOSURE OF INVENTION

However, the disclosures in Patent Documents 1 and 2, electron-beam welding is performed over the entire circumference of the stator blade ring such that joint portions extend from the side surfaces of the shrouds to the middle portions of the stator blades. Thus, the stator blades and the shrouds are subjected to great heat, which may deform the stator blades and the shrouds.

Distortion of the stator blades disturbs the air flow and decreases the compression efficiency. Furthermore, distortion of the shrouds makes, for example, the inner surfaces of the shrouds wavy. Thus, the shrouds are projected into or recessed from the chamber. This creates gaps between the inner surface of a casing of the chamber and the inner surfaces of the shrouds, disturbing the flow in the chamber and decreasing the compression performance.

The present invention has been made in view of the above-described circumstances, and an object thereof is to provide a stator blade ring in which the possibilities of thermal deformation and a decrease in strength can be reduced, the shape flexibility can be ensured, and the compression performance can be improved, and to provide an axial flow compressor using the same.

To solve the above-described problems, the present invention employs the following solutions.

A first aspect of the present invention provides a stator blade ring including stator blade segments in each of which an inner shroud portion and an outer shroud portion divided corresponding to one stator blade are provided at both ends of the stator blade so as to be formed as a single part, and connecting members that are formed of arch-shaped plates and are disposed on at least one of the inner shroud portions and the outer shroud portions of the plurality of stator blade segments adjoining in a circumferential direction, on a side opposite to the stator blades. The stator blade segments are welded to the connecting members at a portion of the length thereof in the circumferential direction.

In this aspect, the stator blade segment formed as a single part is positioned at a predetermined location of the connecting member, and the stator blade segment is welded and fixed to the connecting member at a portion of the length thereof in the circumferential direction. By repeating this for each stator blade segment, arch-shaped portions (stator blade ring segments) of the stator blade ring are formed.

By sequentially inserting fitting portions provided on the sides of the outer shroud portions of these stator blade ring segments into a guide groove provided in a casing, a ring-shaped stator blade ring is formed.

Thus, because the stator blade segments are welded to the connecting member at a portion of the length thereof in the circumferential direction, heat input can be reduced. Furthermore, because the stator blade segments are welded one-by-one in a discontinuous manner, heat can be released to the air and is unlikely to accumulate. In addition, because the stator blade segments are joined at the inner or outer shroud portions, on the side opposite to the stator blades, the influence of the heat on the stator blade is negligible.

Accordingly, it is possible to reduce the risk of thermal deformation of the formed stator blade ring. Because this suppresses turbulence of the compressed air due to thermal deformation, predetermined compression performance can be maintained.

Furthermore, because the stator blade segments and the connecting members are joined by welding, great bonding strength is achieved and sufficient structural strength can be maintained.

Moreover, because the shape of the stator blades is independent of the bonding between the stator blade segments and the connecting members, the shape of the stator blades can be freely determined according to the required compression performance.

In the above-described aspect, it is preferable that the inner shroud portions or the outer shroud portions on which the connecting members are disposed have a groove into which the connecting members are inserted.

This makes it easy to accurately position the stator-blade segments with respect to the connecting members in a direction intersecting the circumferential direction.

In the above-described aspect, it is preferable that a surface of the connecting members opposite to the stator blades be located closer to the stator blades than a surface of the inner shroud portions or the outer shroud portions, on which the connecting members are disposed, opposite to the stator blades.

With this configuration, because the connecting members do not project outward from the inner shroud portions or the outer shroud portions even if they are deformed due to thermal stress, thermal distortion can be tolerated. Furthermore, for example, when the stator blade ring segments are inserted into the guide groove in the casing, the connecting members do not touch the guide groove. Thus, the sliding area between the stator blade ring segments and the guide groove can be reduced, making assembly of the stator blade rings easy.

A second aspect of the present invention provides an axial flow compressor including the stator blade ring in which the possibilities of thermal deformation and a decrease in strength can be reduced, the shape flexibility can be ensured, and the compression performance can be improved.

According to this aspect, because the stator blade ring in which the possibilities of thermal deformation and a decrease in strength can be reduced, the shape flexibility can be ensured, and the compression performance can be improved is provided, the strength and compression performance of the axial flow compressor can be improved.

This can improve the thermal efficiency of, for example, a gas turbine.

In the present invention, the stator blade segments, each formed as a single part, are positioned at predetermined locations of the connecting members and are welded and fixed to the connecting members at a portion of the length thereof in the circumferential direction to form the arch-shaped portions (stator blade ring segments) of the stator blade ring. Thus, it is possible to reduce the risk of thermal deformation of the formed stator blade ring and to maintain sufficient structural strength.

Because turbulence of the compressed air due to thermal deformation is suppressed and the shape of the stator blades can be freely determined according to the required compression performance, predetermined compression performance can be maintained.

EXPLANATION OF REFERENCE SIGNS

Figure 1:
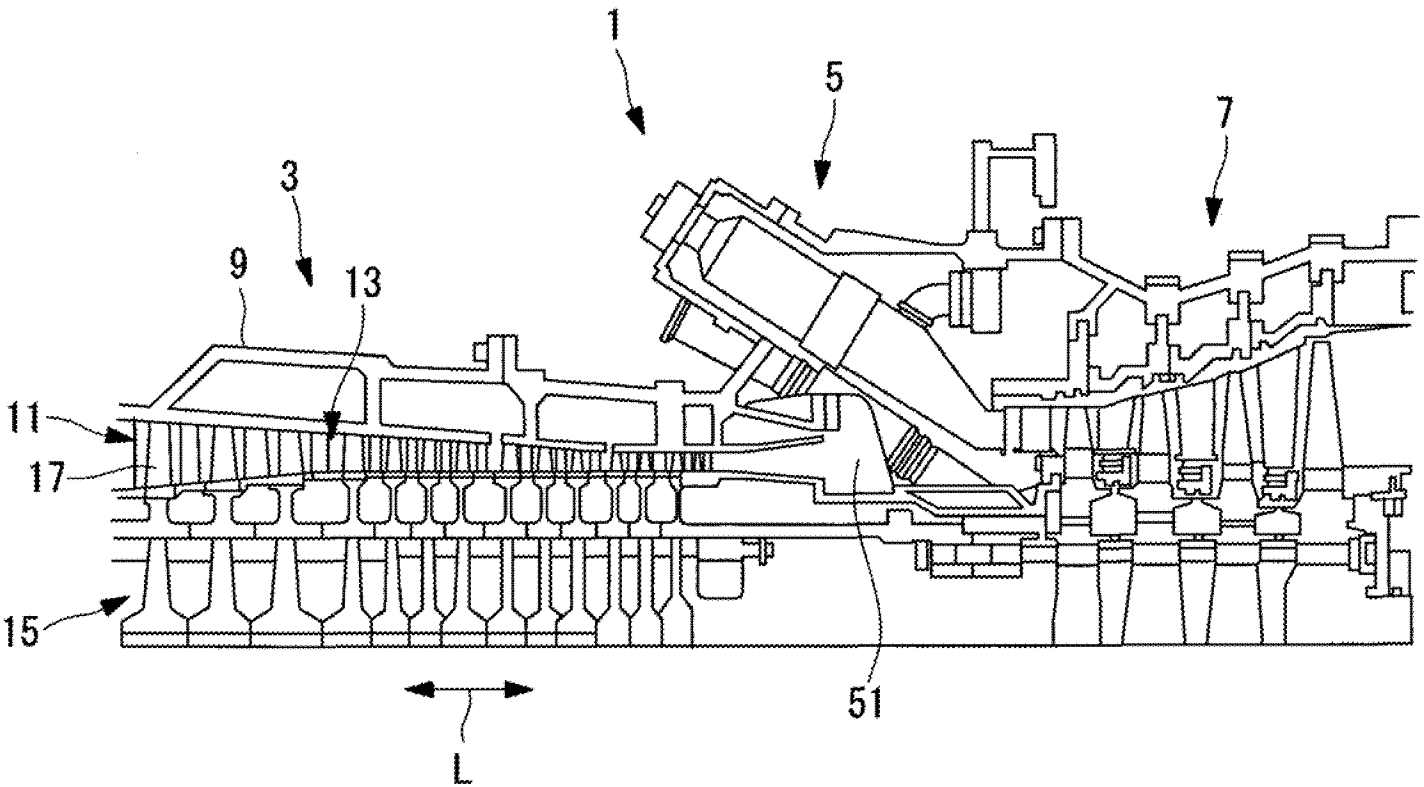
FIG. 1 is a schematic sectional view showing an upper half of a gas turbine using stator blade rings according to an embodiment of the present invention.

1: gas turbine
3: compressor
13: stator blade ring
21: stator blade body
23: connecting member
24: connecting member
27: stator blade
29: outer shroud portion
31: inner shroud portion
37: outer surface
39: groove
P: circumferential direction

BEST MODE FOR CARRYING OUT THE INVENTION

A gas turbine according to an embodiment of the present invention will be described below with reference to FIGS. 1 to 5.

Figure 2:
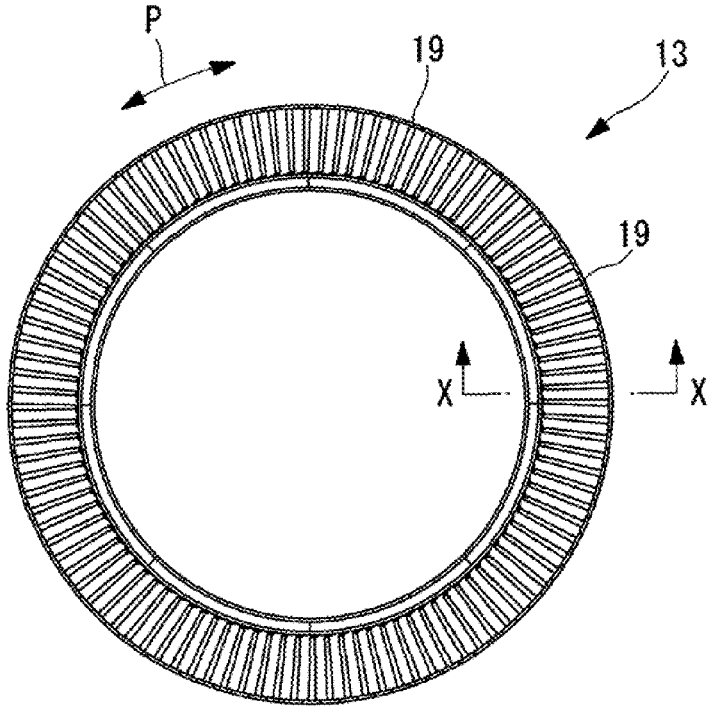
FIG. 2 is a side view showing the stator blade ring according to an embodiment of the present invention.
Figure 3:
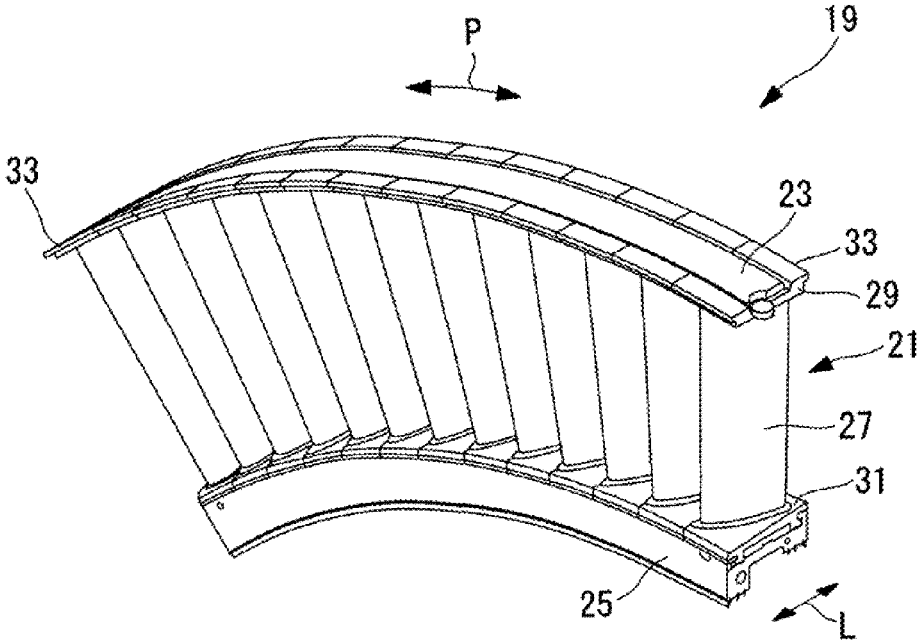
FIG. 3 is a perspective view showing a stator blade ring segment according to an embodiment of the present invention.
Figure 4:
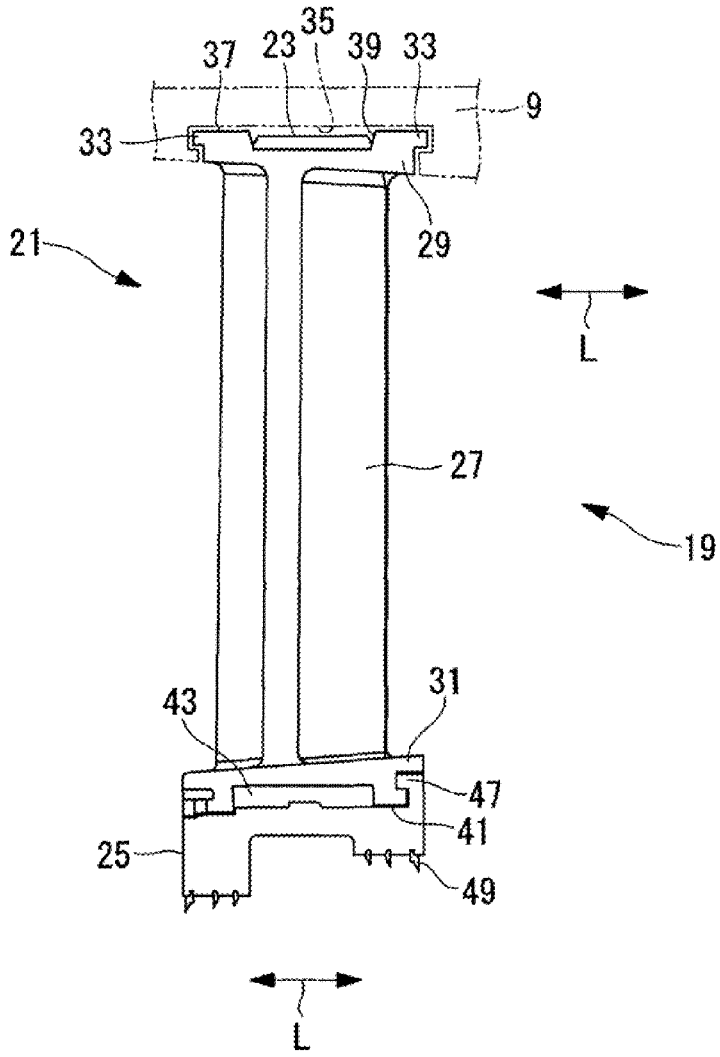
FIG. 4 is a sectional view taken along line X-X in FIG. 2.
Figure 5:
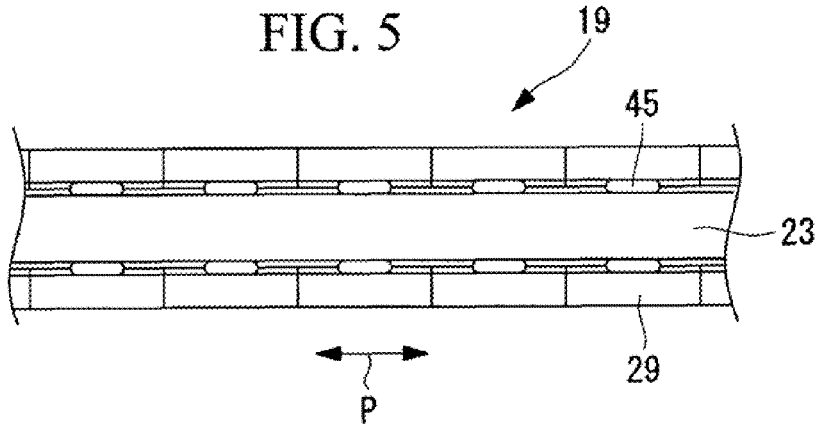
FIG. 5 is a partial plan view of the stator blade ring segment according to an embodiment of the present invention, viewed from the outside.

FIG. 1 is a schematic sectional view showing an upper half of a gas turbine 1 according to this embodiment. FIG. 2 is a side view showing a stator blade ring 13 according to this embodiment. FIG. 3 is a perspective view showing a stator blade ring segment 19 according to this embodiment. FIG. 4 is a sectional view taken along line X-X in FIG. 2. FIG. 5 is a partial plan view of the stator blade ring segment 19, viewed from the outside.

As shown in FIG. 1, the gas turbine 1 includes a compressor (axial flow compressor) 3 that compresses air, combustors 5 that combust fuel using the air compressed by the compressor 3, and a turbine 7 to which combustion gas from the combustors 5 is guided. The components of the gas turbine 1, including the compressor 3, the combustors 5, and the turbine 7, are covered by a casing 9.

The compressor 3 is an axial flow compressor in which moving blade rings 11 and the stator blade rings 13 are arranged alternately in the rotation shaft direction.

The moving blade ring 11 consists of multiple moving blades 17 radially attached around a rotation shaft 15. The multiple moving blades 17 are arranged at substantially equal intervals in the circumferential direction P.

As shown in FIG. 2, the stator blade ring 13 consists of eight stator blade ring segments 19 divided in the circumferential direction P.

As shown in FIG. 3, the stator blade ring segment 19 includes a plurality of stator blade bodies (stator blade segments) 21, a connecting member 23 that is preliminarily formed in an arch shape and connects these stator blade bodies 21, and a seal holder 25.

The stator blade bodies 21 include a stator blade 27 and an outer shroud portion 29 divided so as to correspond to one stator blade 27 and an inner shroud portion 31 divided so as to correspond to one stator blade 27.

The stator blade body 21 is formed as a single part by cutting out the stator blade 27, the outer shroud portion 29, and the inner shroud portion 31 from a 13Cr stainless steel block.

The outer shroud portion 29 is substantially rectangular-parallelepiped-shaped. The outer shroud portion 29 has projections 33 provided at both ends in the rotation shaft direction L, on the outside, over the entire length in the circumferential direction P.

The casing 9 has, in the inner circumferential surface thereof, a guide groove portion 35 that guides the outer shroud portions 29 so as to be freely slidable. The projections 33 fit into recesses provided at both ends of the guide groove portion 35 in the rotation shaft direction L and serve to guide the outer shroud portions 29 during sliding.

The outer shroud portions 29 have a groove 39 in an outer surface 37 (a surface opposite to the stator blades 27), substantially in the middle thereof in the rotation shaft direction L, over the entire length in the circumferential direction P. The sectional shape of the bottom surface of the groove 39 in the circumferential direction P is an arch shape projecting outward. Both ends of the groove 39 in the rotation shaft direction L are inclined so as to open outward.

The inner shroud portion 31 is substantially rectangular-parallelepiped-shaped. The cross section, in the rotation shaft direction L, of the outer surfaces of both ends of the inner shroud portion 31 in the rotation shaft direction L is U-shaped so as to open outward in the rotation shaft direction L.

The inner shroud portions 31 have a groove 43 in an inner surface 41 (a surface opposite to the stator blades 27), substantially in the middle thereof in the rotation shaft direction L, over the entire length in the circumferential direction P.

The connecting members 23 are long plates made of, for example, 13Cr stainless steel. The connecting members 23 are bent to provide arched surfaces. The connecting members 23 each have a length about one-eighth that of the stator blade ring 1.

The connecting members 23 have a trapezoidal transverse-sectional shape, whose long side has substantially the same length as the inner surface of the groove 39 in the rotation shaft direction L. The thickness of the connecting members 23 is smaller than the depth of the groove 39.

When the long side of the connecting member 23 is disposed on the bottom surface of the groove 39, the side surfaces of the connecting member 23 and the side surfaces of the groove 39 form substantially V-shaped grooves.

The stator blade bodies 21 are connected to the connecting member 23 by fitting the connecting member 23 into the groove 39 in the outer shroud portions 29 and welding them by TIG welding. As shown in FIG. 5, the length of welding portions 45 is substantially one-third (a portion of) the length of the outer shroud portions 29 in the circumferential direction.

The welding to be used is not limited to TIG welding, but may be any suitable welding, for example, electron-beam welding.

Figure 6:
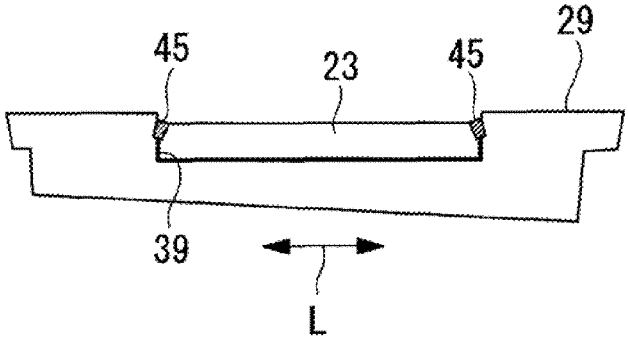
FIG. 6 is a transverse sectional view showing a connecting member according to another embodiment of the present invention, in a fitted state.
Figure 7:
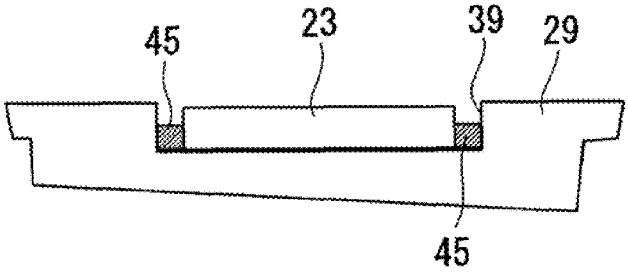
FIG. 7 is a transverse sectional view showing the connecting member according to another embodiment of the present invention, in a fitted state.
Figure 8:
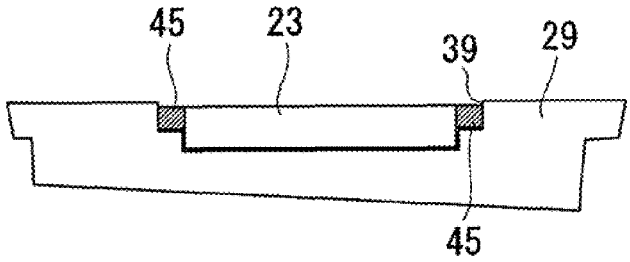
FIG. 8 is a transverse sectional view showing the connecting member according to another embodiment of the present invention, in a fitted state.

Although both ends of the groove 39 in the rotation shaft direction L are inclined so as to open outward, they may be, for example, either substantially perpendicular to the bottom surface, as shown in FIGS. 6 and 7, or stepped, as shown in FIG. 8.

In such cases, the connecting member 23 having an adequate transverse-sectional shape and width are used to conform to the shape of the groove 39.

For example, the connecting member 23 shown in FIG. 6 has a substantially rectangular transverse-sectional shape and substantially the same width as the width of the groove 39.

In this case, the connecting member 23 and the outer shroud portions 29 are joined by filler welding.

When the connecting member 23 and the groove 39 have substantially equal widths, positioning of the connecting member 23 in the rotation shaft direction L can be easily performed.

The connecting member 23 shown in FIG. 7 has a substantially rectangular transverse-sectional shape and a smaller width than the groove 39.

In this case, the welding operation is easy because the welding can be performed so as to fill gaps between the connecting member 23 and the side surfaces of the groove 39.

The connecting member 23 shown in FIG. 8 has a substantially rectangular transverse-sectional shape and substantially the same width as the bottom of the groove 39.

In this case, positioning of the connecting member 23 in the rotation shaft direction L can be easily performed at the side surfaces of the groove 39 on the bottom side, and welding can be easily performed so as to fill gaps between the connecting member 23 and the side surfaces of the groove 39 on the upper side.

The seal holders 25 each have a length about one-eighth that of the stator blade ring 1. Each seal holder 25 has, the upper portions on both sides in the rotation shaft direction L, projections 47 that are meshed with the U-shaped side surfaces of the inner shroud portions 31 that are open outward in the rotation shaft direction L.

Seal members 49 are attached to the bottom of the seal holder 25.

The seal holder 25 communicates and is engaged with all the inner shroud portions 31 constituting the stator blade ring segment 19 and serves to maintain the position of the inner shroud portions 31.

The combustors 5 are connected to the compressor 3 via a compressed-air-supply path 51. The plurality of combustors 5 provided in the circumferential direction combine compressed air supplied through the compressed-air-supply path 51 with separately supplied fuel to combust them to generate high-temperature, high-pressure combustion gas, and then supply it to the turbine 7.

The turbine 7 is an axial flow turbine in which stator blades and moving blades are arranged alternately in the rotation shaft direction L. The moving blades attached to the rotation shaft 15 are moved in the rotation direction by the high-temperature, high-pressure combustion gas, thereby rotating the rotation shaft 15.

The rotation shaft 15 rotates the moving blade rings 11 of the compressor 3 and is connected to, for example, a generator (not shown) to generate electric power.

The assembly and mounting of the thus-configured stator blade rings 13 will be described.

First, a predetermined number of stator blade bodies 21, connecting members 23, and seal holders 25 are manufactured in predetermined shapes.

The stator blade bodies 21 are formed into a predetermined shape by cutting them out from a block of material.

The connecting members 23 are formed by cutting a long plate into predetermined lengths and widths, forming (machining and cutting) inclined surfaces on both side portions thereof, and then bending them into an arch shape having a predetermined radius of curvature.

One stator blade body 21 is brought to an end of one of the connecting members 23. Because the connecting member 23 is preliminarily provided with a mark indicating the setting position of the outer shroud portion 29 at the end thereof, setting is performed such that the connecting member 23 is fitted into the groove 39 in the outer shroud portion 29 with reference to the mark.

As described above, because the positioning of the stator blade bodies 21 with respect to the connecting member 23 in the rotation shaft direction L can be performed by fitting the connecting member 23 into the groove 39, it can be easily and accurately performed.

The groove 39 and the connecting member 23 are joined by performing TIG welding on the V-shaped grooves formed therebetween. As shown in FIG. 5, TIG welding is performed over about one-third the length of each outer shroud portion 29, substantially in the middle thereof in the circumferential direction P.

Then, a second stator blade body 21 is introduced into place. At this time, the second outer shroud portion 29 is positioned (for example, abutted) using the other end surface of the outer shroud portion 29 of the already-joined stator blade body 21 as a mark.

In this state, the second stator blade body 21 is joined to the connecting member 23 by TIG welding in the same way as the above.

By repeating this, a predetermined number of stator blade bodies 21 are joined to the connecting member 23.

Although the second and later ones are positioned using the outer shroud portions 29 as the marks, positioning may be performed by, for example, providing the connecting member 23 with other marks or by measuring the position every time.

After all the stator blade bodies 21 are joined to the connecting member 23, the seal holder 25 is attached to the inner shroud portions 31 of the stator blade bodies 21.

The seal holder 25 is inserted from an end of the inner shroud portion 31 on one end such that the projections 47 thereof are fitted into the side surfaces of the inner shroud portions 31.

Thus, the stator blade ring segment 19 is formed.

The projections 33 provided on both sides of the outer shroud portions 29 form a substantially continuous arch shape.

The manufactured stator blade ring segment 19 is brought to the casing 9. The projections 33 of the stator blade ring segment 19 are fitted into the recesses of the guide groove portion 35 provided in the casing 9, and the stator blade ring segment 19 is slid along the guide groove portion 35 and is disposed at a predetermined position.

By sequentially repeating this, the stator blade ring 13 is assembled.

As described above, because the outer shroud portions 29 of the stator blade bodies 21 are welded to the connecting member 23 at about only one-third the length thereof in the circumferential direction P, heat input to the stator blade bodies 21 is small.

Furthermore, because the stator blade bodies 21 are welded one-by-one in a discontinuous manner, heat associated with welding can be released to the air and is unlikely to accumulate.

In addition, because the stator blade bodies 21 are joined to the connecting member 23 at the groove 39 in the outer shroud portions 29 provided opposite the stator blades 27, the influence of heat due to welding of the stator blades 27 is negligible.

Thus, it is possible to reduce the risk of the formed stator blade ring segments being deformed by heat.

Because this restricts projection or recession of the outer shroud portions 29 into or from the air passage and the stator blades 27 from being deformed, turbulence of the compressed air can be reduced.

Because the compressor 3 can maintain a predetermined compression performance, the thermal efficiency of the gas turbine 1 can be improved.

Furthermore, because the stator blade bodies 21 and the connecting members 23 are joined by welding and have great bonding strength, the stator blade rings 13 can maintain sufficient structural strength.

Moreover, because the shape of the stator blades 27 is independent of the bonding between the stator blade bodies 21 and the connecting members 23, the shape of the stator blades 27 can be freely determined according to the required compression performance.

Because the thickness of the connecting members 23 is set smaller than the depth of the groove 39, the outer surfaces of the connecting members 23 are located more inward (towards the stator blades 27) than the outer surfaces 37 of the outer shroud portions 29.

Because the connecting members 23 do not project outward from the outer shroud portions 29 even if they are deformed due to thermal stress, thermal distortion of the connecting members 23 can be tolerated.

Furthermore, for example, when the stator blade ring segments 19 are inserted into the guide groove 35 in the casing 9, the connecting members 23 do not touch the guide groove 35. Thus, the sliding area between the stator blade ring segments 19 and the guide groove 39 can be reduced, making assembly of the stator blade rings 13 easy.

During operation of the gas turbine 1, the stator blades 27 of the stator blade rings 13 vibrate due to air flow. In this embodiment, because the contact portions of the adjoining inner shroud portions 31 or the contact portions of the seal holder 25 and the inner shroud portions 31 slide and produce a friction damping effect, the vibration of the stator blades 27 can be reduced to a low level.

Because this can reduce the stress acting on the stator blades 27, the thickness of the stator blades 27 can be reduced. Thus, the performance of the compressor can be improved.

The stator blade bodies 21 can be detached by removing the welding portions 45 between the connecting members 23 and the outer shroud portions 29. Thus, for example, if one of the stator blades 27 is broken, it can be replaced easily.

Although, in this embodiment, the outer shroud portions 29 are joined to the connecting members 23 by welding, they are not limited thereto.

Figure 9:
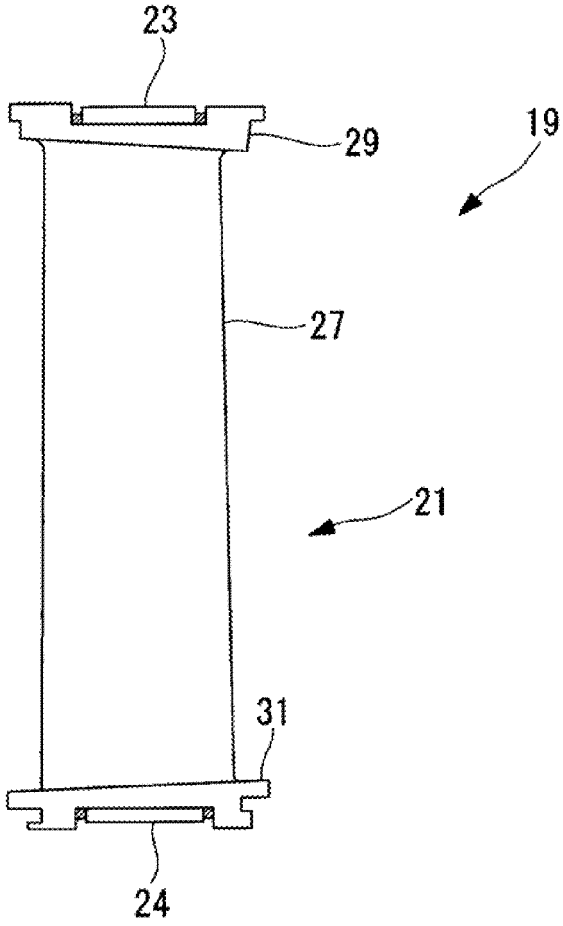
FIG. 9 is a sectional view showing a stator blade body according to another embodiment of the present invention.

For example, as shown in FIG. 9, a connecting member 24 having substantially the same structure as the connecting member 23 may be disposed on the inner shroud portions 31, on the side opposite to the stator blades 27, and the connecting member 24 and the inner shroud portions 31 may be joined by partial welding.

This can improve the strength of the stator blade ring segments 19.

Furthermore, because the connecting member 24 prevents the inner shroud portions 31 from moving freely, the provision of the seal holder becomes unnecessary. Thus, the structure of the stator blade rings 13 can be simplified.

Figure 10:
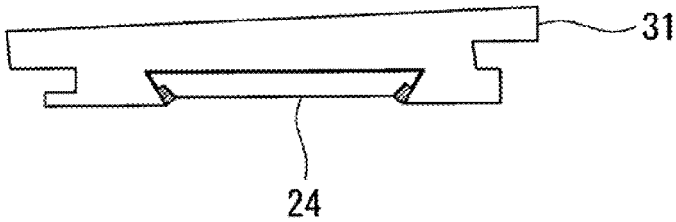
FIG. 10 is a transverse sectional view showing the connecting member according to another embodiment of the present invention, in a fitted state.

As shown in FIG. 10, it is preferable that the connecting member 24 have a trapezoidal transverse-sectional shape and that a groove in the inner shroud portions 31 be shaped so as to narrow toward the inside (the side opposite to the stator blades 27).

This prevents the connecting member 24 from moving toward the rotation shaft 15 even if the welding portions are broken, allowing the connecting member 24 to move freely, thus improving safety.

Figure 11:
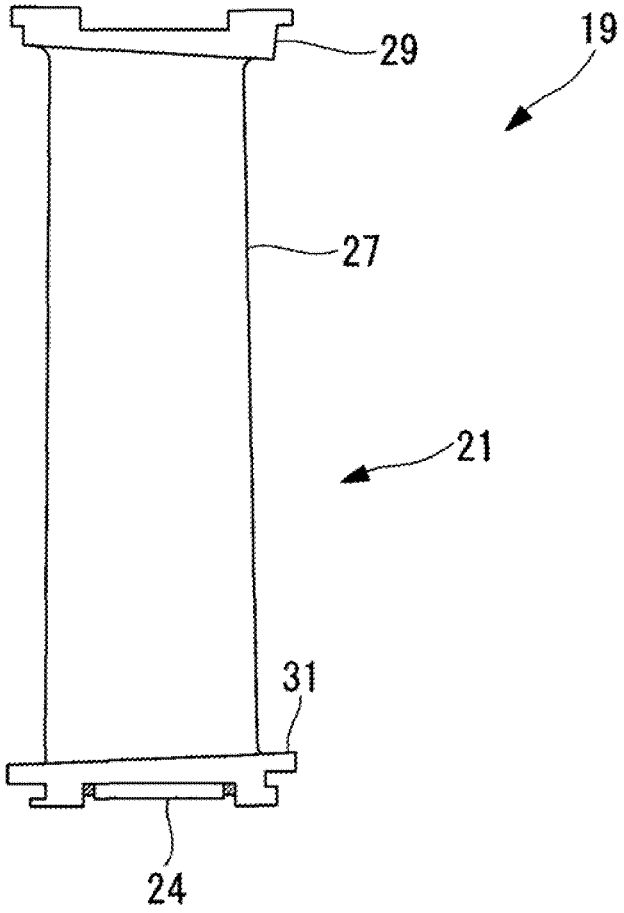
FIG. 11 is a sectional view showing the stator blade body according to another embodiment of the present invention.

In addition, as shown in FIG. 11, the stator blade bodies 21 may be joined only with the connecting member 24, without attaching the connecting member 23.

In this case, because the outer shroud portions 29 may tend to spread in the circumferential direction, it is preferable that such a movement be restricted by adequate means.

The present invention is not limited to this embodiment, but may be adequately modified within the scope not departing from the gist of the present invention.

The invention claimed is:

1. A stator blade ring comprising:

stator blade segments in each of which an inner shroud portion and an outer shroud portion divided corresponding to one stator blade are provided at both ends of the stator blade so as to be formed as a single part; and connecting members that are formed of arch-shaped plates and are disposed on at least one of the inner shroud portions and the outer shroud portions of the plurality of stator blade segments adjoining in a circumferential direction, on a side opposite to the stator blades, wherein the inner shroud portions or the outer shroud portions on which the connecting members are disposed have a groove into which the connecting members are inserted, and wherein the stator blade segments adjoining in a circumferential direction are welded to the connecting members at a portion in the middle in the circumferential direction of each of the stator blades segments.

2. The stator blade ring according to claim 1, wherein a surface of the connecting members opposite to the stator blades is located closer to the stator blades than a surface of the inner shroud portions or the outer shroud portions, on which the connecting members are disposed, opposite to the stator blades.

3. The stator blade ring according to claim 1, wherein a width of a surface of the connecting member toward the stator blade is substantially the same as a width of the groove and a width of an opposite surface of the connecting member toward the stator blade is smaller than the width of the groove, wherein a gap is formed when the connecting member is inserted to the groove between the side surface of the connecting member and the side surface of the groove, and wherein the stator blade segments are connected to the connecting member with the gaps by welding.

4. An axial flow compressor comprising:

the stator blade rings each according to claim 1, and moving blade rings, wherein the moving blade rings and the stator blade rings are arranged alternately in a rotation axis direction.

5. A gas turbine comprising:

the axial flow compressor according to claim 4;

a combustor that combusts fuel using the air compressed by the axial flow compressor; and a turbine to which combustion gas from the combustor is guided.

* * * * *